US006990744B2

(12) United States Patent
Bieganek et al.

(10) Patent No.: US 6,990,744 B2
(45) Date of Patent: Jan. 31, 2006

(54) APPARATUS AND METHOD FOR EVALUATING CLEARANCE FROM A CONTOURED SEAT CUSHION

(75) Inventors: Joseph S. Bieganek, Littleton, CO (US); Thomas R. Hetzel, Littleton, CO (US); Joan Padgitt, Denver, CO (US)

(73) Assignee: Aspen Seating, LLC, Sheridan, CO (US)

( * ) Notice: Subject to any disclaimer, the term of this patent is extended or adjusted under 35 U.S.C. 154(b) by 0 days.

(21) Appl. No.: 10/628,890

(22) Filed: Jul. 28, 2003

(65) Prior Publication Data

US 2005/0022406 A1 Feb. 3, 2005

(51) Int. Cl.
*G01B 7/28* (2006.01)
*A61B 5/103* (2006.01)

(52) U.S. Cl. ..... 33/515; 33/514.2

(58) Field of Classification Search ..... 33/512–513, 33/514.2, 515; 297/217.2, 219.1, DIG. 4; 5/630, 652
See application file for complete search history.

(56) References Cited

U.S. PATENT DOCUMENTS

| | | | | |
|---|---|---|---|---|
| 1,742,183 A | | 1/1930 | Claus | |
| 1,961,641 A | | 6/1934 | Ollis | |
| 2,156,629 A | | 5/1939 | Hutchison | |
| 2,384,713 A | | 9/1945 | Varma | |
| 2,472,754 A | * | 6/1949 | Mead | 33/515 |
| 2,659,418 A | | 11/1953 | Berman | |
| 2,933,738 A | | 4/1960 | Whelan | |
| 3,158,878 A | | 12/1964 | Pernell | |
| 3,177,036 A | | 4/1965 | Halter | |
| 3,222,694 A | | 12/1965 | Schick | |
| 3,511,537 A | | 5/1970 | Ackermann | |
| 3,749,442 A | | 7/1973 | Berg et al. | |
| 3,987,507 A | | 10/1976 | Hall | |
| 4,132,228 A | | 1/1979 | Green | |
| 4,327,046 A | | 4/1982 | Davis et al. | |
| 4,347,213 A | | 8/1982 | Rogers, Jr. | |
| 4,522,447 A | | 6/1985 | Snyder et al. | |
| 4,567,887 A | | 2/1986 | Couch, Jr. | |
| 4,588,229 A | | 5/1986 | Jay | |
| 4,615,856 A | * | 10/1986 | Silverman | 264/222 |
| 4,643,481 A | | 2/1987 | Saloff et al. | |
| 4,682,818 A | | 7/1987 | Morell | |
| 4,726,624 A | | 2/1988 | Jay | |
| 4,753,480 A | | 6/1988 | Morell | |
| 4,756,090 A | * | 7/1988 | Pedrow | 33/512 |
| 4,824,174 A | | 4/1989 | Dunn, Sr. | |
| 4,842,330 A | | 6/1989 | Jay | |
| 4,889,387 A | | 12/1989 | Gregory | |
| 4,890,235 A | | 12/1989 | Reger et al. | |
| 4,912,788 A | | 4/1990 | Lonardo | |
| 4,951,334 A | | 8/1990 | Maier | |

(Continued)

FOREIGN PATENT DOCUMENTS

| | | |
|---|---|---|
| FR | 768163 | 8/1934 |

(Continued)

*Primary Examiner*—Christopher W. Fulton
*Assistant Examiner*—Yaritza Guadalupe
(74) *Attorney, Agent, or Firm*—John R. Ley

(57) ABSTRACT

Clearance between a support contour of a seat cushion and an adjacent pelvic and proximal thigh anatomical portion of a person is evaluated with a clearance measurement device that deforms in response to force applied thereto. The clearance measurement device is located on the support contour at a predetermined location where the clearance is to be evaluated. A person sits on the cushion with the clearance measurement device. The clearance is related to the extent of deformation. Impression foam, a malleable putty-like substance, or a fluid cushion are examples of clearance measurement devices.

44 Claims, 11 Drawing Sheets

U.S. PATENT DOCUMENTS 4,972,351 A 11/1990 Reger et al.
4,998,354 A * 3/1991 Silverman et al. ..... 33/514.2
5,018,790 A 5/1991 Jay
5,079,790 A 1/1992 Pouch
5,092,655 A 3/1992 Deegener et al.
5,163,737 A 11/1992 Navach et al.
5,180,619 A 1/1993 Landi et al.
5,189,747 A 3/1993 Mundy et al.
5,193,285 A 3/1993 Heinrich et al.
5,255,404 A 10/1993 Dinsmoor, III et al.
5,282,286 A 2/1994 MacLeish
5,288,135 A 2/1994 Forcier et al.
5,294,181 A 3/1994 Rose et al.
5,317,773 A 6/1994 Graebe
5,333,921 A 8/1994 Dinsmoor, III
5,343,876 A 9/1994 Rogers
5,352,023 A 10/1994 Jay et al.
5,369,829 A 12/1994 Jay
5,378,045 A 1/1995 Siekman et al.
5,390,384 A 2/1995 Dinsmoor, III et al.
5,395,162 A 3/1995 Jay et al.
5,397,517 A 3/1995 Jay et al.
5,414,884 A 5/1995 Mackenzie
5,442,823 A 8/1995 Siekman et al.
5,444,881 A 8/1995 Landi et al.
5,452,940 A 9/1995 Maier
5,457,833 A 10/1995 Jay
5,461,741 A 10/1995 Graebe
5,470,590 A * 11/1995 Brubaker et al. ..... 425/2
5,490,299 A 2/1996 Dinsmoor, III et al.
5,496,610 A 3/1996 Landi et al.
5,513,899 A 5/1996 Michaels et al.
5,522,106 A 6/1996 Harrison et al.
5,524,971 A 6/1996 Jay et al.
5,551,107 A 9/1996 Graebe
5,551,756 A 9/1996 Gurasich et al.
5,592,707 A 1/1997 Dinsmoor, III et al.
5,613,256 A 3/1997 Hanson
5,613,257 A 3/1997 Graebe
5,617,595 A 4/1997 Landi et al.
5,671,977 A 9/1997 Jay et al.
5,681,092 A 10/1997 Hanson et al.
5,687,436 A 11/1997 Denton
5,836,025 A 11/1998 Poncy, Sr.
5,840,400 A 11/1998 Landi et al.
5,920,915 A 7/1999 Bainbridge et al.
6,018,832 A 2/2000 Graebe
6,032,300 A 3/2000 Bainbridge et al.
6,055,676 A 5/2000 Bainbridge et al.
6,082,824 A 7/2000 Chow
6,161,238 A 12/2000 Graebe
6,182,314 B1 2/2001 Frydman
6,241,320 B1 6/2001 Chew et al.
6,293,026 B1 * 9/2001 Lee et al. ..... 33/512
6,293,625 B1 9/2001 Dixon
6,301,722 B1 10/2001 Nickerson et al.
6,345,401 B1 2/2002 Frydman
6,357,054 B1 3/2002 Bainbridge et al.
6,430,831 B1 * 8/2002 Sundman ..... 33/515
6,453,477 B1 9/2002 Bainbridge et al.
6,493,958 B1 * 12/2002 Tadin ..... 33/515
6,502,263 B1 1/2003 Rowley et al.
6,611,980 B2 9/2003 Wempe
6,625,897 B2 * 9/2003 Tadin ..... 33/515
6,845,568 B2 * 1/2005 Ward ..... 33/515
6,883,243 B2 * 4/2005 Ramcke ..... 33/561.2
6,904,692 B2 * 6/2005 Tadin ..... 33/515
2001/0013146 A1 * 8/2001 Wempe ..... 5/654
2003/0121103 A1 * 7/2003 Wempe ..... 5/654
2005/0025953 A1 * 2/2005 Hetzel et al. ..... 428/304.4
2005/0116380 A1 * 6/2005 Tadin ..... 264/223

FOREIGN PATENT DOCUMENTS

GB 2016918 10/1979

* cited by examiner

APPARATUS AND METHOD FOR EVALUATING CLEARANCE FROM A CONTOURED SEAT CUSHION

CROSS-REFERENCE TO RELATED APPLICATIONS

This invention is related to other inventions made by at least one of the inventors herein for Individually-Contoured Seat Cushion and Shape Capturing and Fabricating Method for Seat Cushion described in U.S. patent application Ser. No. 10/628,858, for Modular Seat Cushion with Interlocking Human Support and Base Portions and Method of Creating a Seat Cushion described in U.S. patent application Ser. No. 10/628,859, and for Contoured Seat Cushion and Method for Offloading Pressure from Skeletal Bone Prominences and Encouraging Proper Postural Alignment described in U.S. patent application Ser. No. 10/628,860, all of which are filed concurrently herewith and all of which are assigned to the assignee of the present invention. The subject matter of these concurrently-filed applications is incorporated herein by reference.

FIELD OF THE INVENTION

This invention relates to seat cushions. More particularly the present invention relates to a new and improved apparatus and method for evaluating the effectiveness of a support contour of a seat cushion against that portion of the user's anatomy in contact with the seat cushion. The new and improved apparatus and method of the present invention is particularly useful in evaluating the degree of clearance between the support contour and the skin of the user, thereby indicating the ability of the support contour to avoid pressure and shear forces on the skin of the user with a subsequent decrease in risk for pressure ulcers. The present invention is particularly useful in evaluating the effectiveness of seat cushions for wheelchair users, although the present invention is not specifically limited to such use. The clearance evaluation information is obtained quickly, inexpensively and effectively.

BACKGROUND OF THE INVENTION

A wheelchair seat cushion must perform a number of important functions. The seat cushion should be comfortable and capable of providing proper support for optimal posture and posture control for a considerable length of time. The seat cushion should also assist, or at least not materially hinder, the user in maneuvering the wheelchair, permit a useful range of motion from the pelvis and upper torso of the person, and create stability and security for the person within the wheelchair. Perhaps most importantly, the seat cushion should help prevent and reduce the incidence of pressure ulcers created by prolonged sitting on the cushion without adequate pressure relief. Pressure ulcers can become a very serious health problem for individuals who must remain constantly in contact with the support cushion, and it is important to avoid such pressure ulcers.

Wheelchair users like everyone are of substantially different sizes, weights and shapes. Many wheelchair users have physical disabilities and associated posture and postural control impairments such as those typically caused by congenital disorders. Other wheelchair users, such as those who have been disabled by acquired or traumatic injuries, may have a more typical size and shape. In all of these cases, the support contour of the wheelchair seat cushion must safely support the anatomy of the user, whether the anatomy is abnormal or more typical. Wheelchair seat cushions must fit and perform properly to prevent further physical impairment and pressure ulcers. The cushion must also enhance the functional capabilities of the user by supporting independence in activities of daily living.

To provide the best individualized support, the cushion must accommodate the anatomical particularities and preferences of the user. Custom wheelchair cushions are used for this purpose. A custom wheelchair cushion is created from an impression of the anatomy of the user. After capturing a shape of the user's anatomy, the captured shape is used to construct a mold for the cushion. Then the mold is used to fabricate the cushion, including the support contour which interfaces with the user's anatomy from which the shape was originally captured. There are a number of different theories for configuring the support contour to address the perceived needs and requirements of the user.

The most prevalent approach used to configure the support contour of a custom cushion, at least at the time of filing hereof, is to distribute the weight of the user substantially uniformly over the entire support contour. The uniform pressure distribution is theorized to reduce the incidence of pressure ulcers because the uniform pressure distribution is thought to avoid localized high-pressure points which cause pressure ulcers. The substantial conformance of the support contour to the anatomical shape of the user is also believed to encourage the user toward proper postural alignment.

A new support theory is described in the above-identified U.S. patent application Ser. No. 10/628,860. This new support theory is based on offloading and isolating pressure and shear forces from the skin surrounding the bony prominences of the user's pelvic area skeletal structure. Applying this support theory involves configuring the support contour with additional clearance, and therefore achieving greater pressure relief, around the ischial tuberosities, the greater trochantors, the coccyx and the sacrum in the pelvic area, while transferring more support to the broader tissue and musculature below the proximal thigh leg bones and at the posterior lateral buttocks. Pressure and shear forces on the skin around the bony prominences is relieved, and pressure is transferred to the broader tissue areas to encourage proper postural alignment.

The effectiveness of implementing any of the different support theories depends on evaluating the fit of the support contour. The user may offer comment about the feel of the support contour. However, in some cases the user is unable to offer meaningful comments, because the aspects of the fit may not be apparent to the user except in extremely exaggerated circumstances. Some wheelchair users may not have the neurological capacity to feel those areas of their anatomy which contact the seat cushion. It is common for a trained assistant to insert his or her fingers between the user and the support contour to evaluate the degree of clearance, but such an approach generally does not provide an objective evaluation. Moreover, certain areas of fit, such as the area directly under the user at the ischial tuberosities cannot be felt at all, because this location is too far underneath the user to be reached. For the evaluation to be effective, the user cannot move from a normal sitting position, because to do so alters the entire interaction of the anatomy with the support contour to such a degree that no aspect of the fit is normal. Moving to an abnormal position against the support contour to provide space for finger evaluation is therefore meaningless.

Pressure mapping has also been used to evaluate the fit of a person with the support contour of a seat cushion. Pressure mapping requires the use of a blanket-like device having hundreds or thousands of pressure sensors distributed in a grid-like manner over the entire surface. Each of the pressure sensors is connected by electrical conductors. The blanket-like pressure mapping device is placed on top of the support contour, and the individual is seated on top of the mapping device. The pressure sensors of the mapping device are located between the support contour and the anatomy of the individual. By individually reading the pressure measurements of each sensor, and correlating the positions of the sensors relative to the support contour, the pressure distribution over the entire support contour can be evaluated. Any areas of increased pressure, where pressure ulcers may ultimately occur, are accurately identified.

Such pressure mapping devices are quite effective. However, they are also expensive and require auxiliary computer support equipment to correlate the individual pressure measurements to positions on the support contour and to evaluate the pressure distribution over the support contour. The vast majority of providers and prescribers of specialized seat cushions do not have access to pressure mapping devices. Pressure mapping is costly and requires a degree of training to become competent in its use.

While such pressure mapping devices are effective in evaluating relative pressure, they are not effective in measuring the extent or degree of clearance. In general, an indication of a lack of pressure is a suggestion of some amount of clearance at a particular location between the anatomy and the support contour, but the extent of the clearance or separation is not indicated by a relative lack of pressure.

Some support theories are primarily dependent on clearance, rather than pressure. One such support theory is described in the above-referenced U.S. patent application Ser. No. 10/628,860. This support theory requires sufficient clearance at locations where pressure is completely offloaded from the bony prominences of the pelvic area of the user, and maintenance of that clearance during acceptable changes in posture of the user, during normal ranges of user movement. The clearance should also accommodate a reasonable level of tissue change or atrophy over time. Under these circumstances, the degree or amount of clearance becomes a very important variable. The degree of clearance relates to the ability of the support contour to accommodate or compensate for the range of posture changes, normal movement and tissue and musculature atrophy before those changes become so significant that the clearance disappears and the risk of pressure ulcers arises. An indication of a relative lack of pressure under one postural, movement or tissue condition may not be a reliable indication of sufficient clearance to avoid pressure and shear forces on the tissue under other dynamic conditions. A pressure mapping device is not entirely useful to evaluate the clearance relationship of the user's anatomy relative to the support contour of the seat cushion, under these circumstances.

Many of the same considerations also apply with varying levels of criticality to other uses of seat cushions. For example, seat cushions used in office environments are required to support the user in a comfortable manner which encourages proper posture and without creating risks of medical problems, for example inducing blood circulatory problems. Evaluating the suitability of a support contour of an office chair to an office worker, or a similar situation is within the scope of the present invention.

SUMMARY OF THE INVENTION

This invention obtains information concerning the fit of a user's anatomy in relation to the support contour of a seat cushion in a relatively quick, inexpensive and effective manner. The amount of clearance between the anatomy of the user and the support contour at selected locations is evaluated. The clearance may be evaluated at any location where the support contour contacts the anatomy, including those locations which cannot readily be accessed while the user remains in proper and usual contact with the support contour. The clearance information may be evaluated under dynamic circumstances caused by changes in posture, normal movement and other actual conditions of use. The clearance may be evaluated without the use of sophisticated and expensive measuring equipment. The clearance information is particularly useful in evaluating the risk of pressure ulcers to a wheelchair user under circumstances where the support contour of the wheelchair seat cushion is intended to offload pressure and shear forces by establishing a desired amount of clearance from the user's anatomy at certain locations.

These and other aspects and features of the invention are realized from a method of evaluating clearance between a support contour of a seat cushion and an adjacent pelvic and proximal thigh anatomical portion of a person sitting on the cushion. The method involves the use of a clearance measurement device which deforms in response to force applied thereto. The clearance measurement device is located on the support contour at a predetermined location where the clearance is to be evaluated. A person sits on the cushion with the clearance measurement device located between the person's anatomical portion and the support contour at the predetermined location where the clearance is to be evaluated. The clearance at that predetermined location is evaluated by determining the extent to which the clearance measurement device was deformed.

The clearance measurement device may take the form of a piece of impression foam having a crush characteristic which collapses the impression foam upon the application of force to the impression foam. The clearance is evaluated by the extent to which the impression foam has collapsed. The crush characteristics of the impression foam preferably provide a capability to collapse to between 80% and 90% of its initial non-collapsed thickness. The preferable crush resistance or force is within the range of 1.50 to 1.85 pounds per square inch.

The clearance measurement device may also take the form of a piece of putty-like substance having a malleable characteristic which indents upon the application of force to the putty. The clearance is evaluated by establishing a predetermined thickness of the putty-like substance. The extent to which the putty-like substance was indented is then determined.

The clearance measurement device may also take the form of a flexible envelope containing fluid. Pressure is applied to the flexible envelope by sitting the person on the cushion with the envelope between the anatomical portion and the support contour. The clearance is evaluated by determining the amount of fluid remaining in the envelope. Preferably, the envelope includes a one-way valve which permits fluid flow out of the envelope but prevents fluid flow into the envelope.

The method of the present invention is particularly useful for determining a better one of a plurality of different cushions which each have a different support contour. The method is used in the manner described with a first cushion having a first support contour, and is then performed again with a second cushion having a second support contour. The better one of the two support contours is selected by evaluating the clearances of the two support contours relative to one another.

A more complete appreciation of the scope of the present invention and the manner in which it achieves the above-noted and other improvements can be obtained by reference to the following detailed description of presently preferred embodiments taken in connection with the accompanying drawings, which are briefly summarized below, and by reference to the appended claims.

DETAILED DESCRIPTION

Although not limited specifically in this regard, the present invention is particularly useful in measuring the clearance between an individual 20 and a support contour 22 (FIGS. 2–5) of a seat cushion 24 used with a wheelchair 26. When used in circumstances not involving a wheelchair 26, the present invention is useful in evaluating the clearance between an individual and a support contour of some other type of cushion or seat which supports a portion of a person's anatomy.

Figure 1:
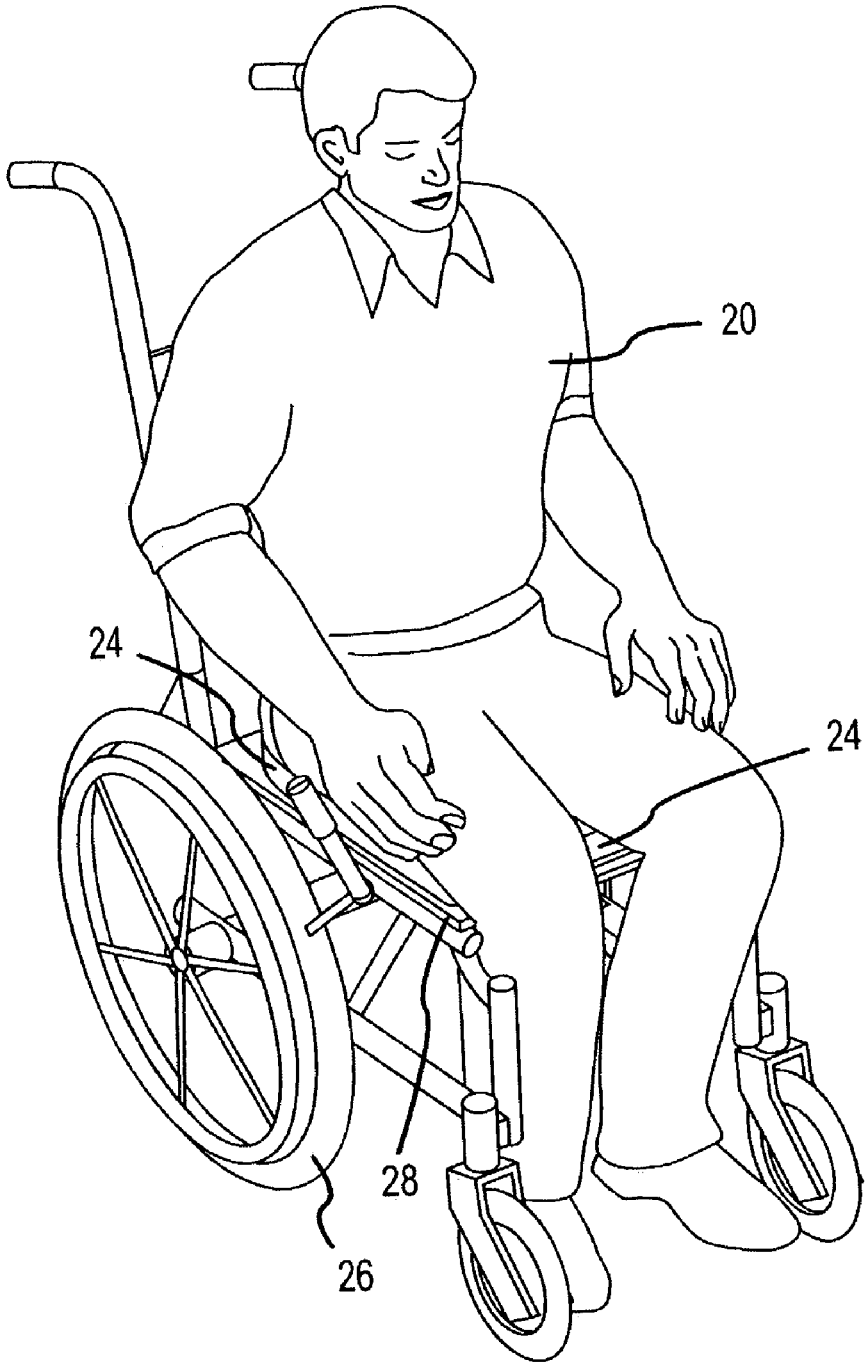
FIG. 1 is a perspective view of a user sitting on a cushion in a wheelchair, with respect to which aspects of the present invention may be advantageously applied.
Figure 2:
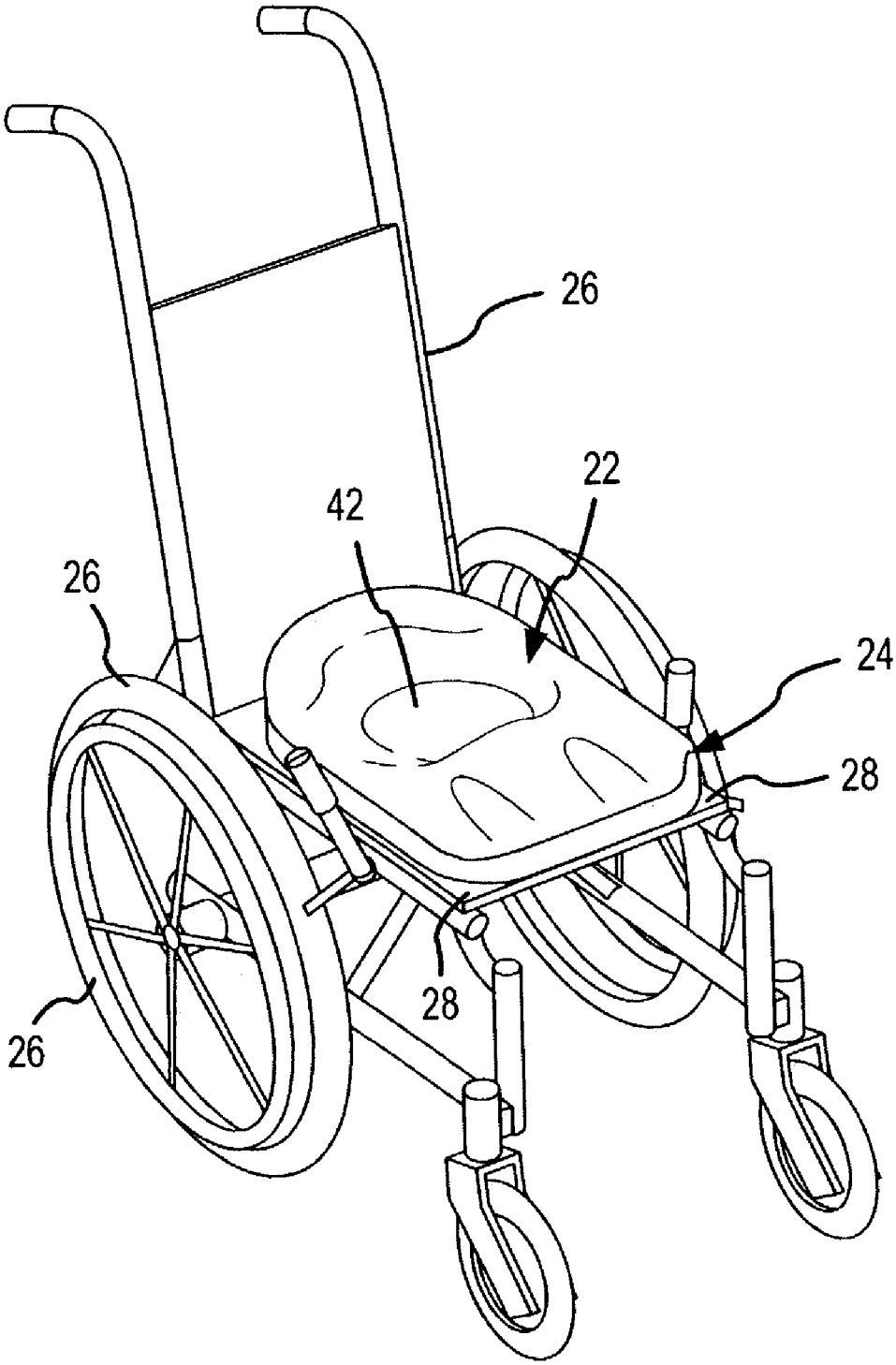
FIG. 2 is based perspective view similar to FIG. 1, but not showing the user and instead showing a support contour of a wheelchair seat cushion upon which the user was sitting in FIG. 1.

As may be understood from FIGS. 1 and 2, the user 20 sits on the cushion 24 in the wheelchair 26. The wheelchair 26 includes a conventional seat support structure 28 to position and locate the cushion 24 so that the pelvic and proximal leg regions of the user's anatomy contact the support contour 22 of the cushion 24. The support contour 22 is configured in accordance with a particular type of support theory to provide support for the user 20 while seated on the cushion 24. The support should provide comfort, relative freedom from pressure ulcers due to continued sitting, freedom from other medical problems, encourage proper postural alignment, and other things.

One advantageous type of support theory is described in the above-referenced U.S. patent application Ser. No. 10/628,860. That support theory involves offloading pressure and shear forces from the skin in areas surrounding bony prominences of the user's skeletal structure. The offloading is accomplished by providing a relatively significant relief or clearance between the support contour 22 and the bony prominences created by the ischial tuberosities 30, the greater trochanters 32, and the coccyx 34 and sacrum 36 of the pelvic area skeletal structure 38, as understood from FIGS. 3, 7 and 8. The greater relief for clearance in these areas is established by the configuration of the support contour 22. The support contour 22 faces upward to contact and support the tissues of the user which surround the pelvic area skeletal structure 38 and the skeletal structure of the proximal thigh leg bones (the femurs) 40.

To offload pressure and provide clearance with respect to the bony prominences of the pelvic area 38 and to apply contact and support pressure at the other areas of the pelvic area 38, the support contour 22 includes a relatively deep center cavity 42 which is positioned in the support contour 22 to be located directly below ischial tuberosities 30 of the pelvic skeletal structure 38, when the user is seated on the cushion 24 as shown in FIGS. 3, 4, 7 and 8. The vertical depth and horizontal dimensions of the cavity 42 are sufficient to provide a clearance between the tissue surrounding the ischial tuberosities 30 and a lowermost surface area 44 of the cavity 42. The lowermost surface area 44 extends the clearance over a range sufficient to accommodate the normal range of movement of the lower ends of the ischial tuberosities 30 resulting from normal movement of the pelvis and upper torso of the user.

Figure 3:
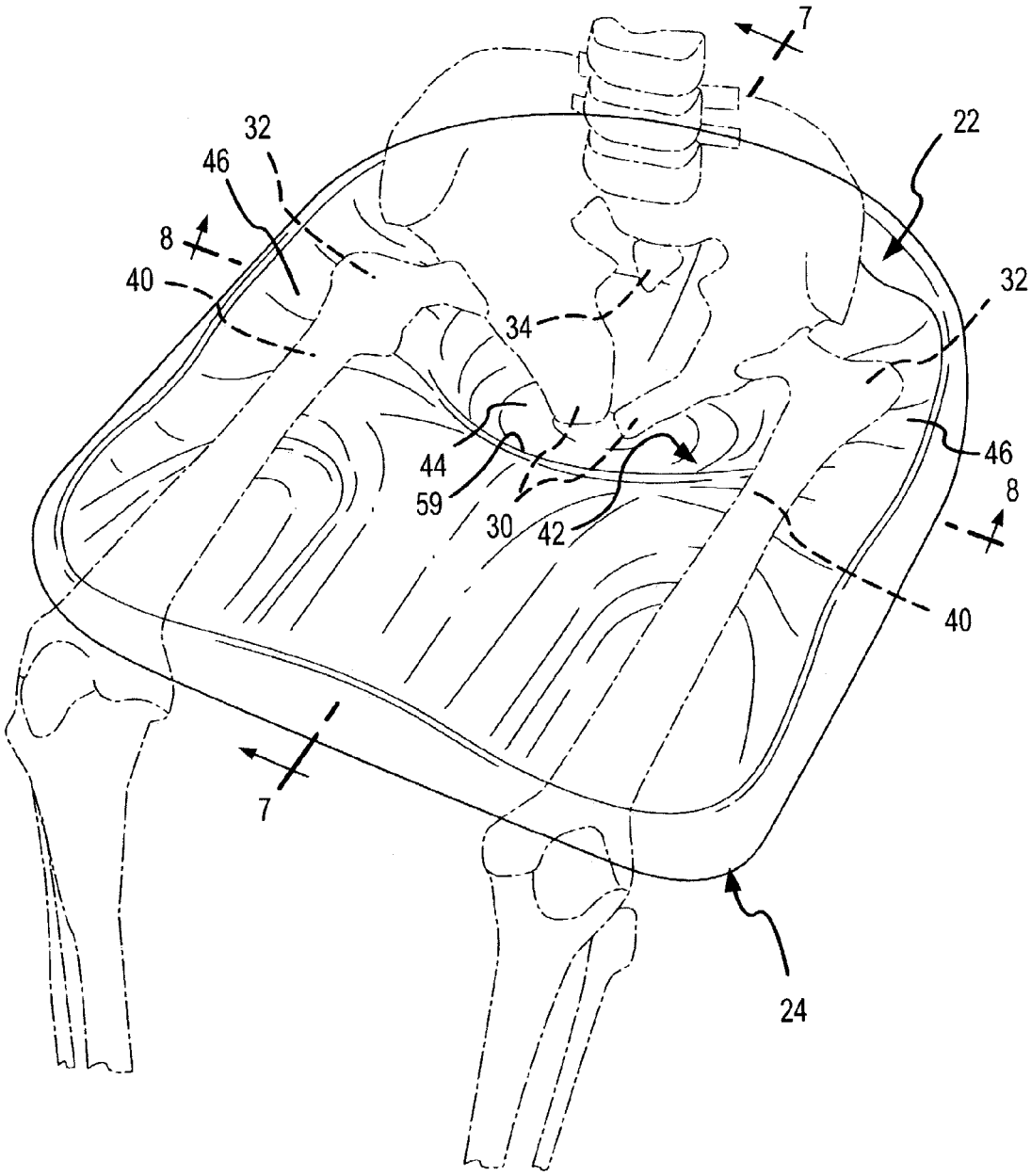
FIG. 3 is an enlarged perspective view of the contour of the wheelchair seat cushion shown in FIG. 2, showing a typical human pelvic and thigh skeletal structure superimposed over aspects of the support contour under conditions where the user is seated in the wheelchair seat cushion as shown in FIG. 1.
Figure 4:
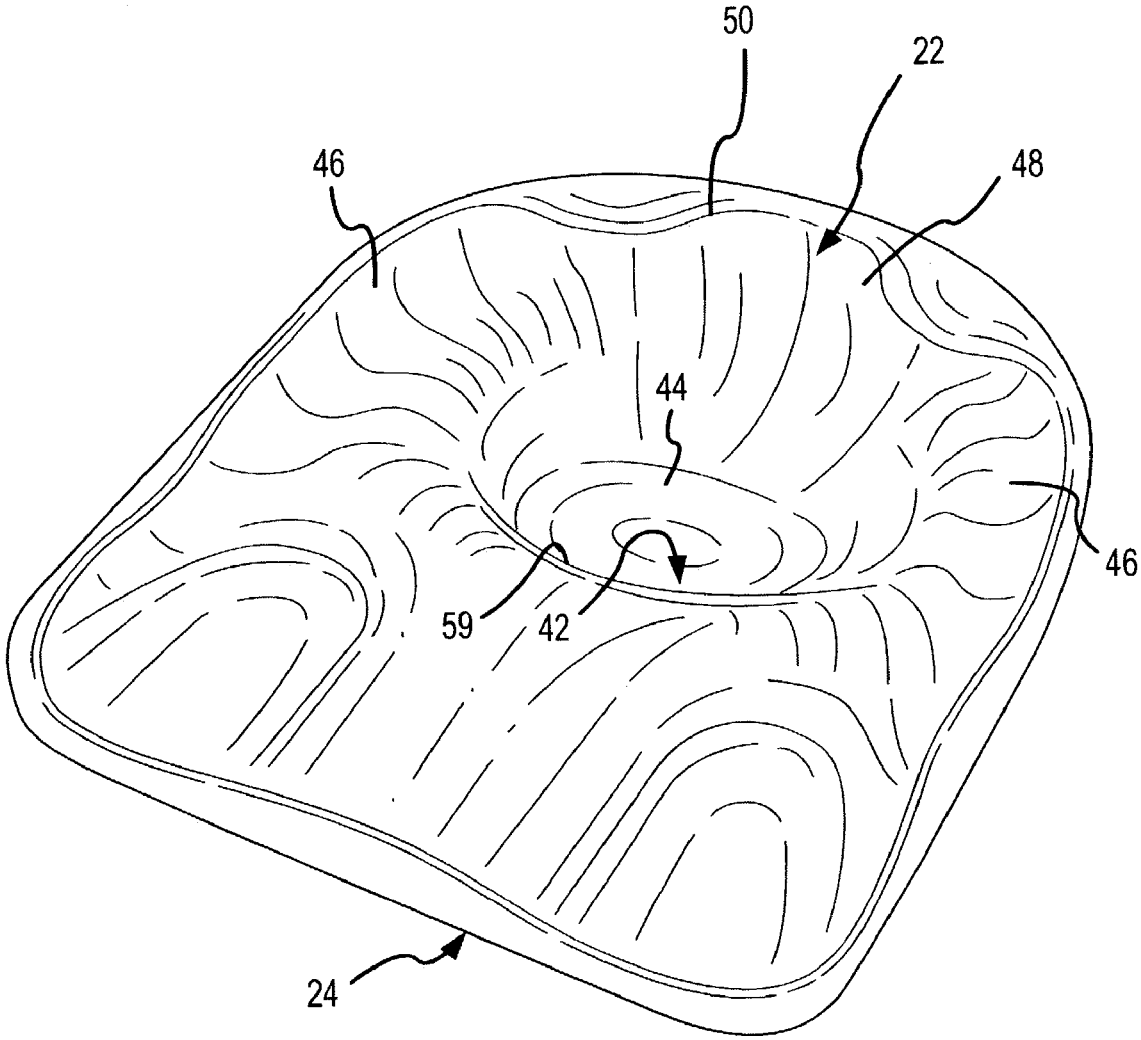
FIG. 4 is an enlarged perspective view of the support contour of the wheelchair seat cushion shown in FIG. 3, with details of the pelvic and thigh skeletal structure removed.
Figure 8:
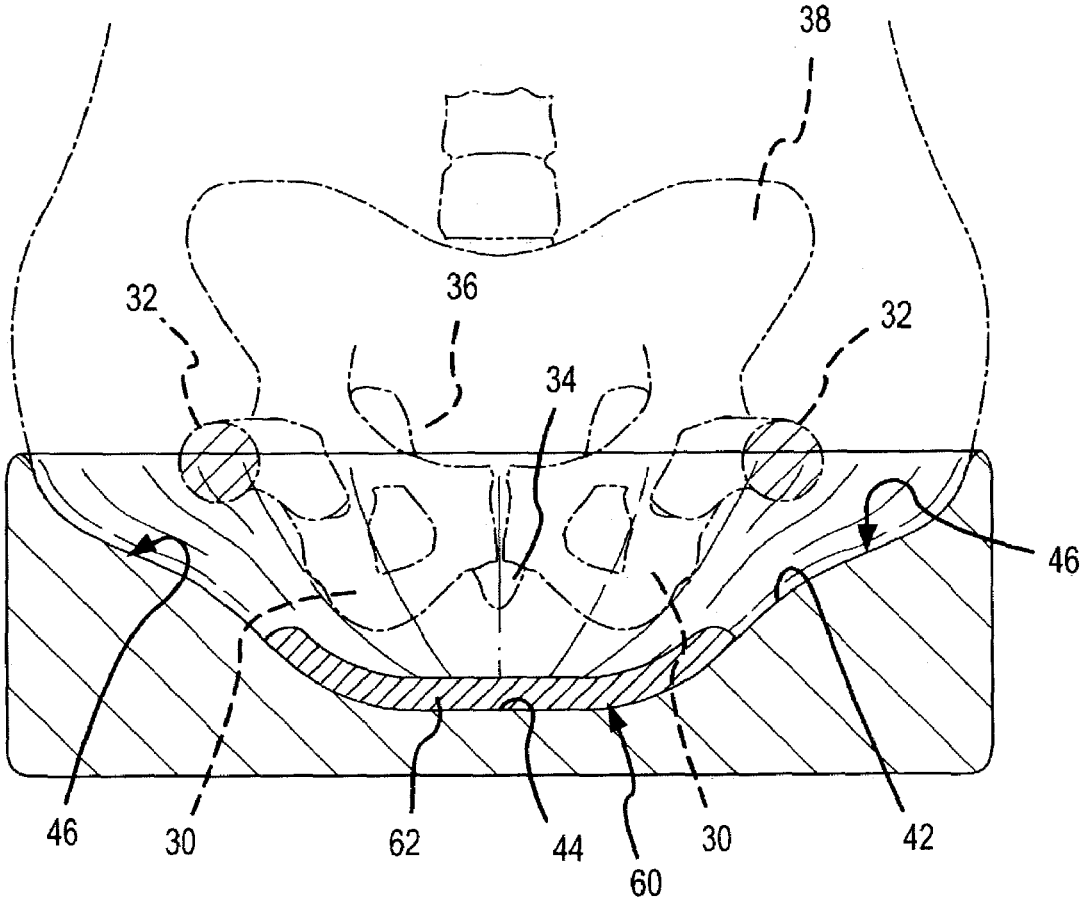
FIG. 8 is a transverse and vertical cross-sectional view taken substantially in the plane of line 8—8 of FIG. 3, showing use of the clearance measuring device shown in FIG. 6.

The support contour 22 rises from the lowermost surface area 44 on opposite transverse sides of the cavity 42 to a relief area 46. A horizontal portion of the relief area 46 is located directly below the greater trochanters 32 on opposite lateral sides of the pelvic skeletal structure 38, when the user is seated on the cushion 20. The relief area 46 also curves transversely outwardly and upwardly from where the horizontal portion of the relief area 46 generally joins the cavity 42. The horizontal and the transversely outwardly and upwardly curved portions of the relief area 46 is shaped to establish a radius-like clearance with respect to the greater trochanters 32, and this clearance is effective to offload pressure and sheer forces from the greater trochanters 32, as shown in FIGS. 3 and 8. The clearance from the relief area 46 is also sufficient to provide flexibility in positioning of the greater trochanters during changes in posture and sitting position.

The support contour 22 also includes a vertically extending indented or convex channel area 48 which extends vertically upward from the lowermost surface area 44 of the cavity 42. The channel area 48 is located at approximately the transverse center of a rear wall 50 of the cavity 42. The channel area 48 is positioned in the support contour 22 to be located directly behind the coccyx 34 and the sacrum 36 of the pelvic skeletal structure 38, when the user is seated in the cushion 24. The degree of indention of the channel area 48 into the rear wall 50 establishes clearance between the channel area 48 and the coccyx 34 and sacrum 36. The amount of this clearance is sufficient to offload pressure from the tissue surrounding the coccyx and sacrum. The amount of clearance extends transversely beyond each opposite lateral side of the coccyx 34 and the sacrum 36, to accommodate a normal range of movement of the user and a reasonable amount of tissue atrophy.

Figure 5:
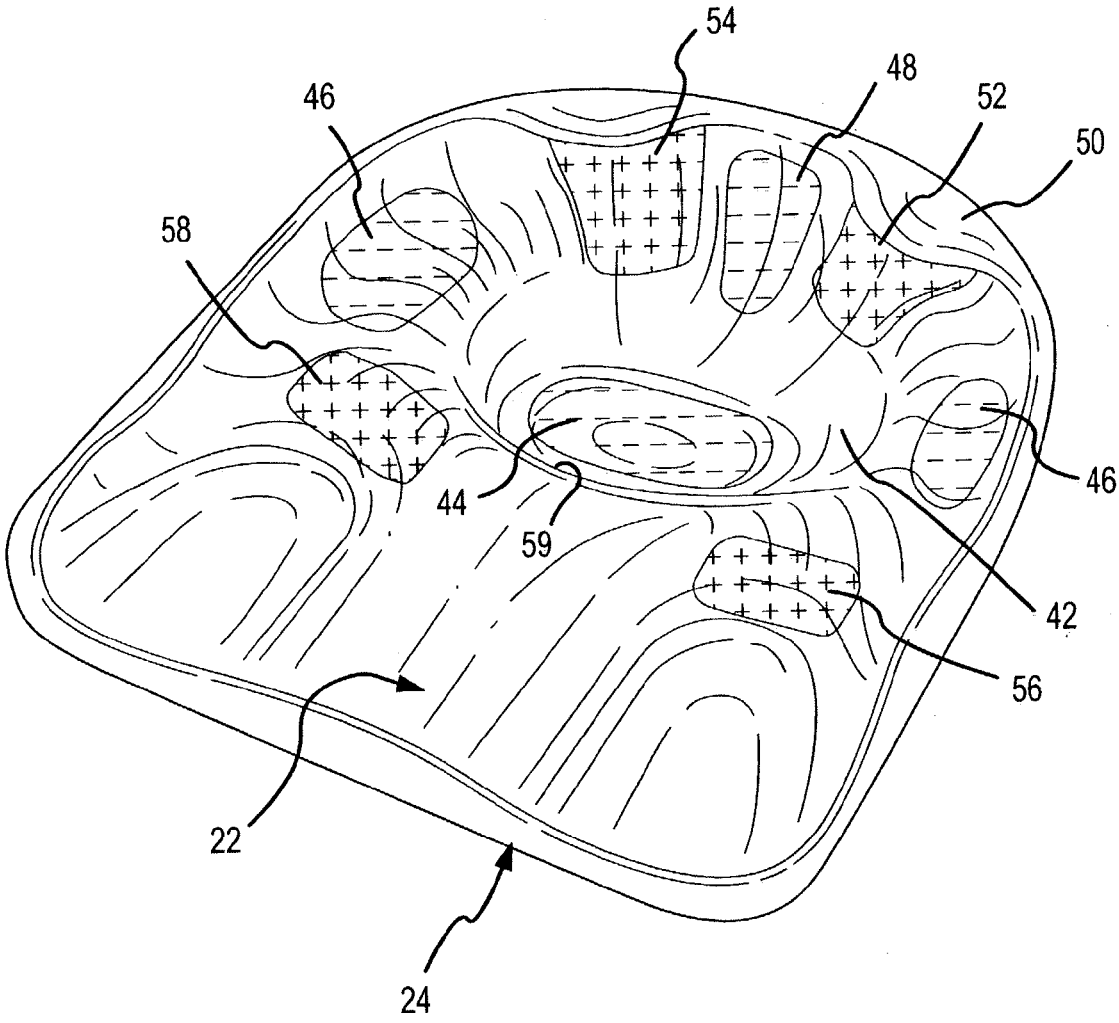
FIG. 5 is a perspective view similar to FIG. 3, with added areas of cross hatching and shading to indicate areas of the support contour shown in FIG. 3 which experience increased pressure and increased clearance.

The lowermost surface area 44 of the cavity 42, the relief areas 46, and the channel area 48 generally have the shape and position, relative to the anatomical shape of the user, to provide additional clearance in the support contour 22 in the location of the areas 44, 46 and 48, as shown in FIG. 5. To compensate for the increased clearance in the areas 44, 46 and 48, the support contour 22 provides greater or enhanced support in other areas 52, 54, 56 and 58 where there are relatively large masses of tissue and muscle upon which greater pressure can be applied without creating localized pressure points. The tissue and musculature contacted by the support areas 52 and 54 is generally on the posterior lateral buttocks. The support areas 56 and 58 contact the relatively broad and massive tissue and musculature extending along the posterior thigh bone 40 proximal to the greater trochanters 32. The support areas 56 and 58 are able to transfer significant force through the posterior thigh bones 40 to the pelvic area skeletal structure 38. The location of the enhanced support areas 52, 54, 56 and 58 orients the structural pelvic area 38 toward a position of proper postural alignment while supporting the pelvic area in a manner that establishes a clearance in the areas 44, 46 and 48.

The increased clearance from the areas 44, 46 and 48, and the increased prominence of the support areas 52, 54, 56 and 58, make the support contour 32 more generally applicable to different classes of users. By adjusting the extent of clearances in the areas 44, 46 and 48 and the extent of the prominence of the support areas 52, 54, 56 and 58, a few different sizes or configurations of the support contour 22 will generally accommodate a relatively wide population of users. The benefits of the support contour 22 are therefore able to be extended to a substantial population of wheelchair users by providing a few different types of seat cushions. This benefit is more specifically described in the above-referenced U.S. patent application Ser. No. 10/628,859.

The support contour 22 also includes a clearance or relief area 59 which provides additional clearance in the perineal or genital area for the user sitting on the support contour 22. The additional clearance area 59 creates a space for relief of pressure and enhancement of air circulation where the skin is prone to breakdown from heat and moisture. Relieving the pressure and providing a space for air circulation in the area 59 is a substantial benefit to wheelchair and other users who must remain seated for long periods of time, by reducing the incidence of skin breakdown and sores in the perineal area.

The clearance area 59 generally curves upwardly and forwardly from the lowermost surface area 44 of the cavity 42. This upward and forward curvature is more gentle and extends farther forward than a more abrupt vertical and forward curvature of the cavity 42 beneath the thigh bones 40. Consequently in a transverse sense, the area 59 extends slightly forwardly from the rear of the thigh support areas 56 and 58, as shown in FIGS. 3, 4, 5 and 7.

Figure 6:
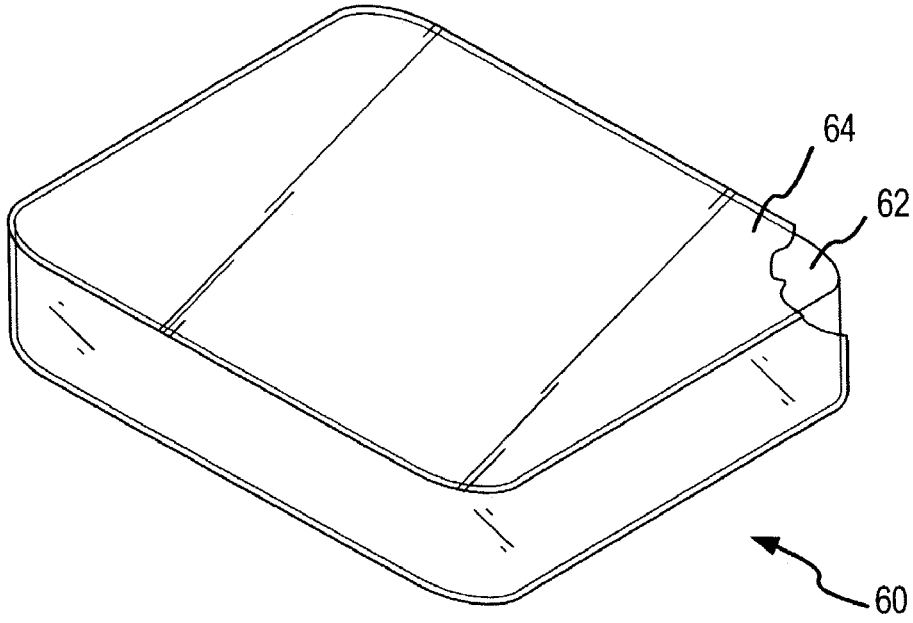
FIG. 6 is a perspective view of one embodiment of a clearance measuring device in accordance with the present invention, with a portion broken away.

A clearance measuring device 60, shown in FIG. 6, is used in accordance with the present invention to measure the clearance between the contacting portion of the individual's anatomy and the support contour 22 of the seat cushion 24 (FIG. 1). The clearance measuring device 60 comprises a pad 62 of collapsible impression foam confined within a clear flexible envelope 64. The foam pad 62 generally has a longitudinal and transverse horizontal dimensions (as shown in FIG. 6) which are sufficient to cover each of the areas 44, 46 or 48 of the support contour 22 (FIG. 5) in which clearance is provided to offload pressure and shear forces from the anatomy in those areas. However, the longitudinal and transverse horizontal dimensions (as shown in FIG. 6) may also be sufficient to cover only a portion of one of the areas 44, 46 and 48 (FIG. 5). The vertical thickness dimension (as shown in FIG. 6) of the foam pad 62 is approximately the thickness necessary to achieve a desired degree of collapse of the impression foam, but not to fully collapse the impression foam, when the device 60 is used.

Figure 7:
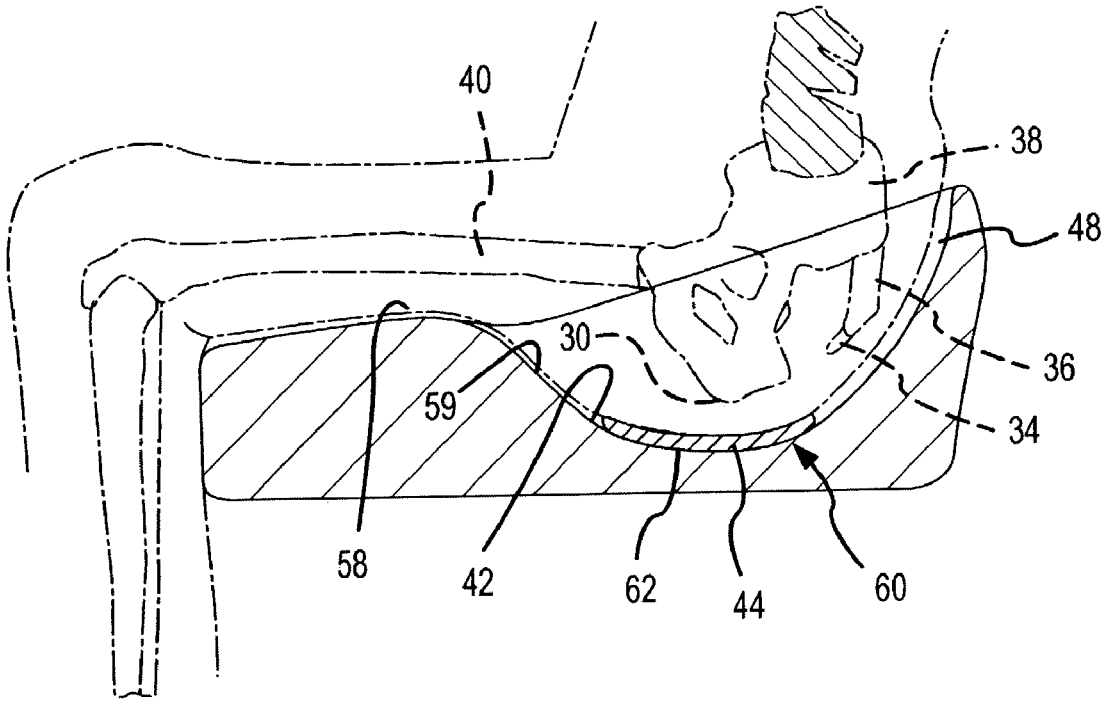
FIG. 7 is a midline longitudinal and vertical cross-sectional view taken substantially in the plane of line 7—7 of FIG. 3, showing use of the clearance measuring device shown in FIG. 6.
Figure 9:
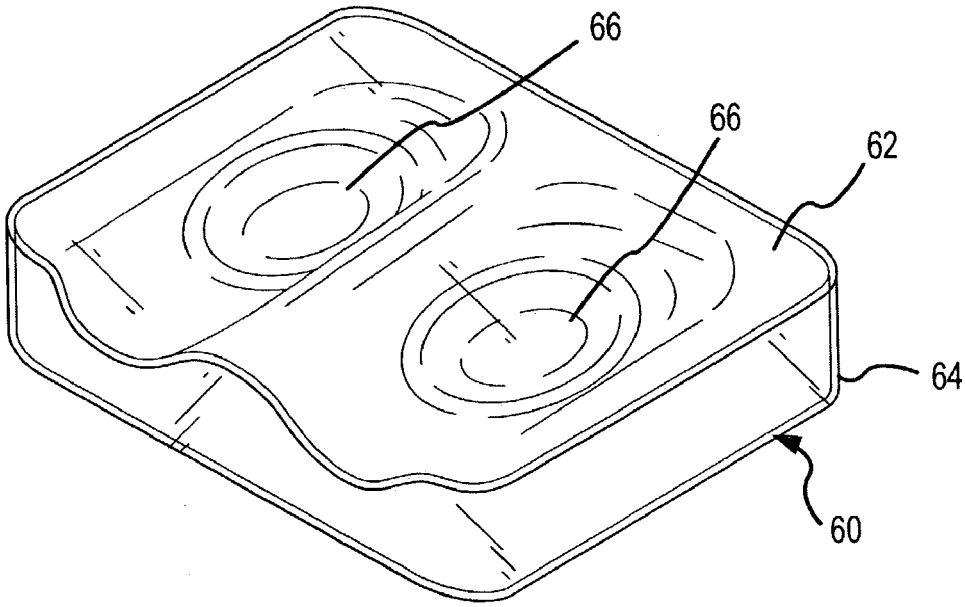
FIG. 9 a perspective view of the clearance measuring device shown in FIG. 6, that has been partially crushed by use in the manner illustrated in FIGS. 7 and 8.

The clearance measuring device 60 is used as shown generally in FIGS. 7–9. The device 60 is placed at a desired location on the support contour 22 where a clearance is to be measured. In the case of the support contour 22 shown in FIG. 5, the device would normally be placed to cover all or part of one of the areas 44, 46 or 48 where a clearance has been configured into the support contour 22 to offload pressure and shear forces from the user's anatomy. As an example, shown in FIGS. 7 and 8, the device 60 has been placed at the bottom of the cavity 42 on the lowermost surface area 44. After the device 60 is placed at the desired location; the user sits down or otherwise contacts the support contour 22 in the normal manner with the device 60 positioned between the user's anatomy and that portion of the support contour 22 where the clearance is to be measured. For example, as shown in FIGS. 7 and 8, the user has seated himself or herself on the support contour 22 with the device positioned at the lowermost surface area 44. The user's ischial tuberosities 30 and the surrounding tissue contacts the device 60 and compresses the foam pad 62. Collapse, indention or compression of the foam pad 62 occurs to an extent indicating the amount of clearance between the tissue surrounding the ischial tuberosities 30 and the lowermost surface area 44 of the support contour 22.

Depending upon the type of clearance measurement desired, the user may remain static while in contact with the support contour 22, or may move through the normal range of movement that would typically occur while the user is in dynamic contact with the support contour. The degree of collapse, indention or compression of the foam pad 62, if any, will be evaluated to determine the amount of clearance under the static conditions. Under the dynamic conditions created by user movement, the compression of the foam pad 62 will reflect variations in clearance created by the movement.

After the foam pad 62 of the device 60 has been positioned and compressed between a selected position on the support contour 22 and the user's anatomy, the user is removed from contact with the device 60 and the support contour 22. An impression 66 will have been created in the foam pad 62, as shown in FIG. 9, as a result of compression of the foam pad 62 by contact between the user's anatomy and the support contour 22. The extent of compression of the foam pad 62 at the impression 66 is then evaluated to determine the amount of clearance. The remaining uncrushed or uncompressed thickness of the foam pad 62 represents the amount of clearance.

Figure 10:
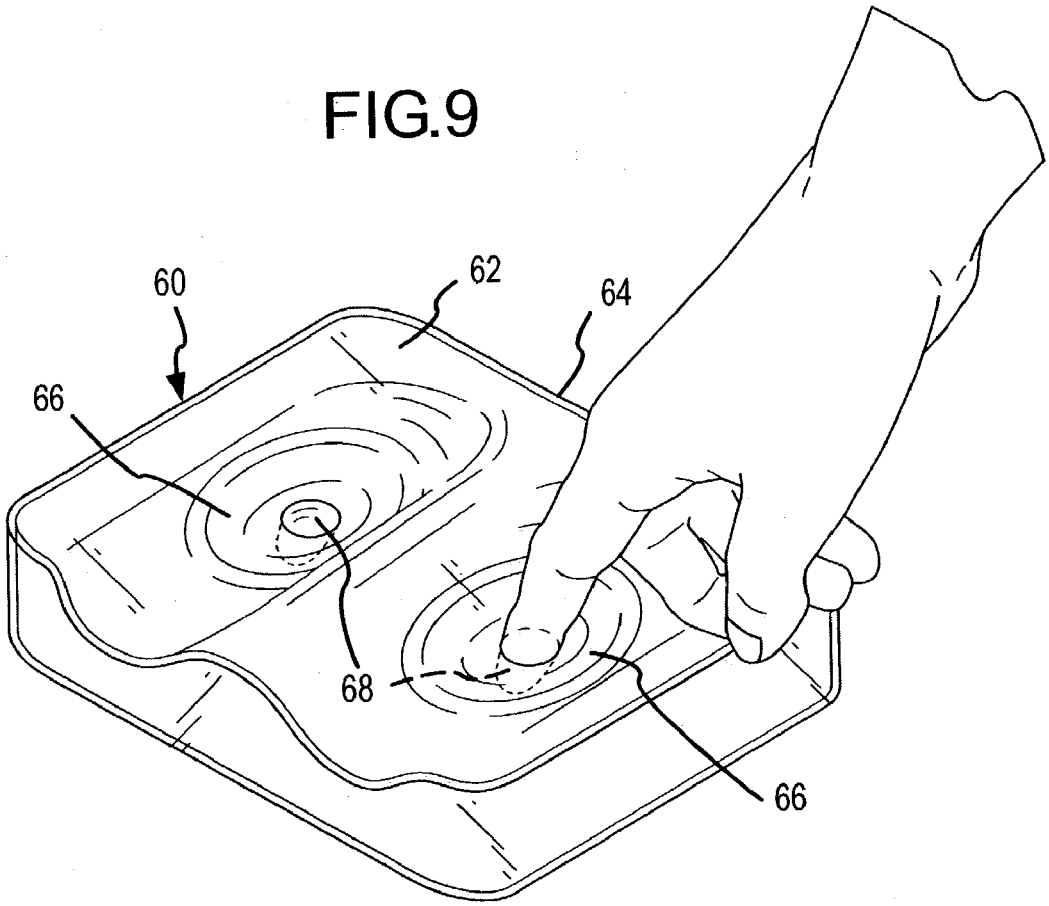
FIG. 10 is a perspective view of the clearance measuring device shown in FIG. 9 in to which a depression has been made by pressure from a finger tip.

To the extent that the impression 66 is located in the interior of the foam pad 62, as shown in FIG. 9, the amount of compression of the interior portions of the impression 66 may be evaluated by creating an indention 68 in the impression 66, as shown in FIG. 10. The indention 68 may be created by finger pressure, or by using a suitable tool. The indention 68 is made by crushing or compressing the foam pad 68 to the maximum extent possible. The depth of the indention 68 from the point in the impression 66 represents the amount of clearance at that location. Although there will be a small residual amount of fully compressed foam at the bottom of the indention 68, the crush characteristics of the impression foam used in the pad 62 are such that the fully crushed thickness is a relatively small fraction, for example 10% to 20% of the original thickness of the pad 62. Of course, a hole (not shown) can also be formed through the impression 66 at the interior of the crushed foam pad 62, and the thickness measured through the hole.

Figure 11:
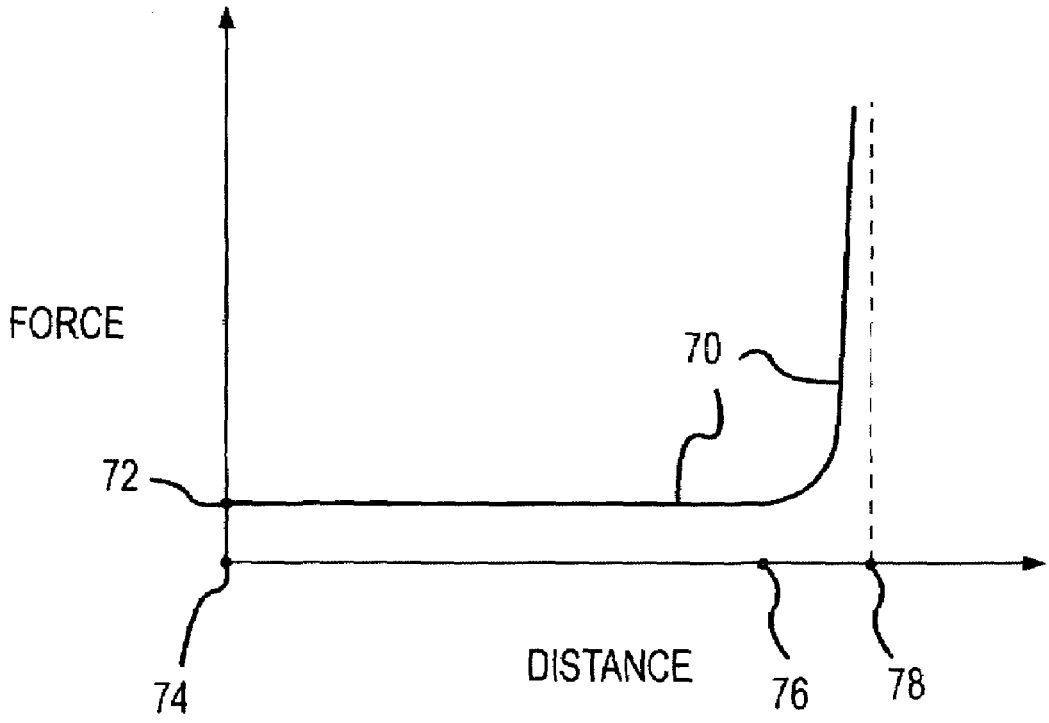
FIG. 11 is a graph illustrating a relationship of crush distance and crush resistance characteristics of impression foam used in the clearance measuring device shown in FIGS. 6–10.

The ability to obtain accurate clearance measurements by evaluating the extent to which the foam pad 62 is crushed or compressed results from the crush characteristics of the impression foam used in the pad 62. The important crush characteristics are illustrated by the curve 70 shown in FIG. 11. The amount of crush force required to crush the foam over a considerable distance is referenced at point 72. The crush force 72 remains essentially constant from point 74 to approximately point 76. When the impression foam has been crushed to the extent represented by point 76, the crushing force increases substantially and almost instantaneously within a relatively slight further crushing distance. Crushing the impression foam past point 76 requires substantially increased force, as shown by the almost vertical extension of the curve 70 past point 76.

It is within the range of crushing distances between points and 74 and 76 that the impression foam of the present invention should be used. Point 74 represents the uncrushed surface of the foam pad 62 (FIG. 6) and point 76 represents the maximum depth to which the impression foam can be collapsed from its original surface while experiencing approximately constant crush force 72. The distance represented between the points 74 and 76 is related to the initial thickness of the foam pad 62 (FIG. 6). The distance between points 74 and 78 represents a typical initial thickness of a foam pad 62 which will achieve a constant force or resistance crushing depth between points 74 and 76.

The average ratio of the original height or thickness of the impression foam (the distance between points 74 and 78) and the distance that the impression foam will crush under relatively uniform force or resistance (the distance between points 74 and 76) is preferably equal to or greater than 5 to 1 (5:1). The average ratio of the original starting thickness of the impression foam to the maximum compressed height at the asymptotic limit of the vertically extending portion of the curve 70 is approximately 10 to 1 (10:1). The ability of the impression foam to collapse in range of ⅕ to 1/10 of its original thickness assures that a sufficient thickness of non-collapsed impression foam in the pad 62 by which to evaluate the amount of clearance. To the extent that the clearance is very small or nonexistent, that circumstance will be revealed as a result of the foam pad 62 becoming fully crushed. However, under those circumstances, the thickness of the fully crushed foam pad will usually not be so great as to create such an unusual abnormal thickness against the support contour 22 that adversely influences the position of the anatomy against the support contour.

In addition to the desired crush-distance characteristics, the impression foam has an extremely low modulus of elasticity, making it very inelastic. The crushed portions (e.g. the impression 66, FIG. 9) of the impression foam are permanently collapsed, and will rebound only insignificantly when the crushing force is removed. This characteristic allows the impression foam to retain the impression 66 that is pressed or formed into the foam pad 62. This characteristic also allows the amount of clearance to be evaluated after the foam pad has been crushed.

The impression foam also has very slight compressive strength. The slight compression strength allows for accurate and precise compression or crushing of the foam pad 62 without the foam pad 62 adversely influencing the fit of the anatomy within the support contour 62. Impression foam which has proved satisfactory has a preferred crushing force resistance of approximately 1.56 pounds per square inch. In general, however, an acceptable range of crushing force resistance will be within the range of 1.50–1.85 pounds per square inch. Higher crushing forces might resist the weight and contact of the user's anatomy to such a degree that a greater amount of actual clearance would be shown than would exist without the foam in place. Lower crushing force resistance will cause the impression foam to crumble and crack, making the created impression 66 useless or difficult to evaluate.

The impression foam collapses or crushes by first crushing the exterior layers of the foam lattice structure. As the crushing progresses, thin layers of crushed or failed material build up adjacent to the forcing shape because those failed layers have been fully compressed, in the same manner as full compression of the entire thickness of the impression foam, represented by the distance between points 76 and 78. Thin layers of the impression foam material beneath the fully crushed layers continue to crush at the uniform resistance or force represented by point 72 until the extent of the crushing reaches its full extent at point 76.

Impression foam having these preferred characteristics is similar to the type of foam used by florists in creating flower arrangements. However, much of the floral foam does not crush sufficiently within the preferred range of crushing force resistance. Some of the other preferred characteristics of the impression foam may also be met by typical floral foam. However, manufacturers of floral foam are able to adjust their fabrication processes to achieve impression foam having the characteristics preferred for use in this invention.

Figure 12:
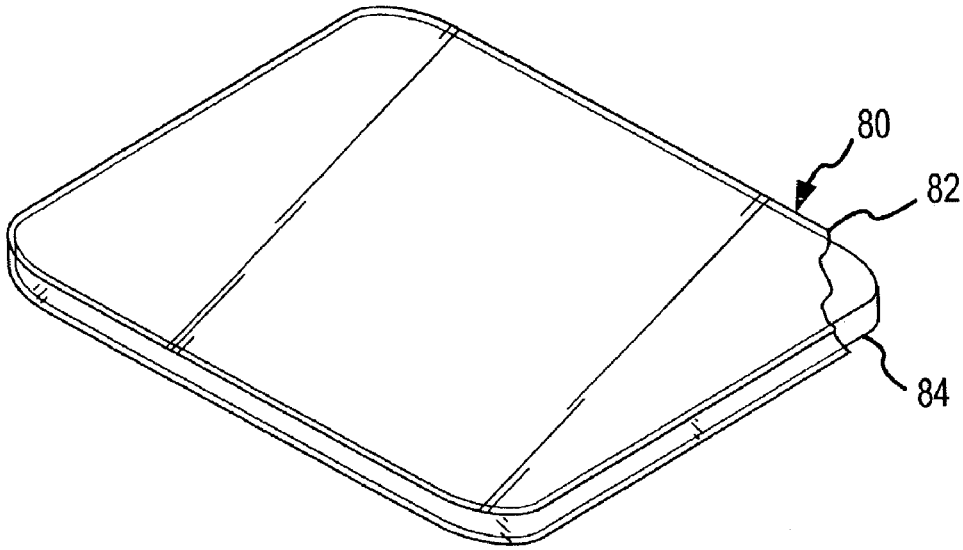
FIG. 12 is a perspective view of another embodiment of a clearance measuring device in accordance with the present invention, with a portion broken away.

Another embodiment 80 of a clearance measuring device in accordance with the present invention is shown in FIG. 12. The clearance measuring device 80 is formed by a pad 82 of malleable, non-resilient material such as putty, which is enclosed within a clear flexible envelope 84. The pad 82 is formed with sufficient longitudinal and transverse horizontal dimensions to cover the portion of the support contour 22 where the clearance measurement is to be obtained. The pad 82 is formed to have a uniform vertical thickness equal to the desired amount of clearance which is to be measured.

To evaluate the clearance, the pad 82 is placed in contact with that portion of the support contour 22 where the clearance is to be measured. The user's anatomy is thereafter contacted in the normal manner with the support contour.

Depending upon whether a static clearance measurement or a dynamic clearance measurement is desired, the user either remains stationary while in contact with the support contour or the user moves through a normal range of movement. Thereafter, the user withdraws from contact with the support contour.

Figure 13:
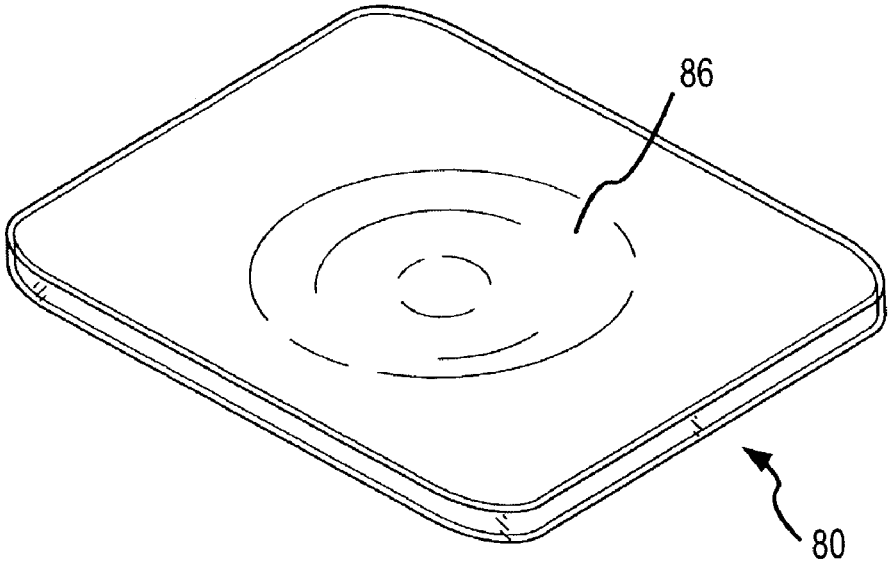
FIG. 13 is a perspective view of the clearance measuring device shown in FIG. 12, having a top contour into which a depression has been made.

The pad 82 is then evaluated, as shown in FIG. 13. If an impression 86 has been formed in the pad 82, such an impression indicates less clearance than the desired amount of clearance represented by the initial thickness of the pad 82. The extent of the clearance can be evaluated by comparing the remaining amount of material of the pad beneath the impression 86 to the original thickness of the pad 82. However, the clearance measurement device 80 will typically be used simply to evaluate the existence of adequate clearance, without attempting to measure the amount of clearance. The existence of an adequate amount of clearance will be determined by the absence of an impression 86 in the pad 82.

Figure 14:
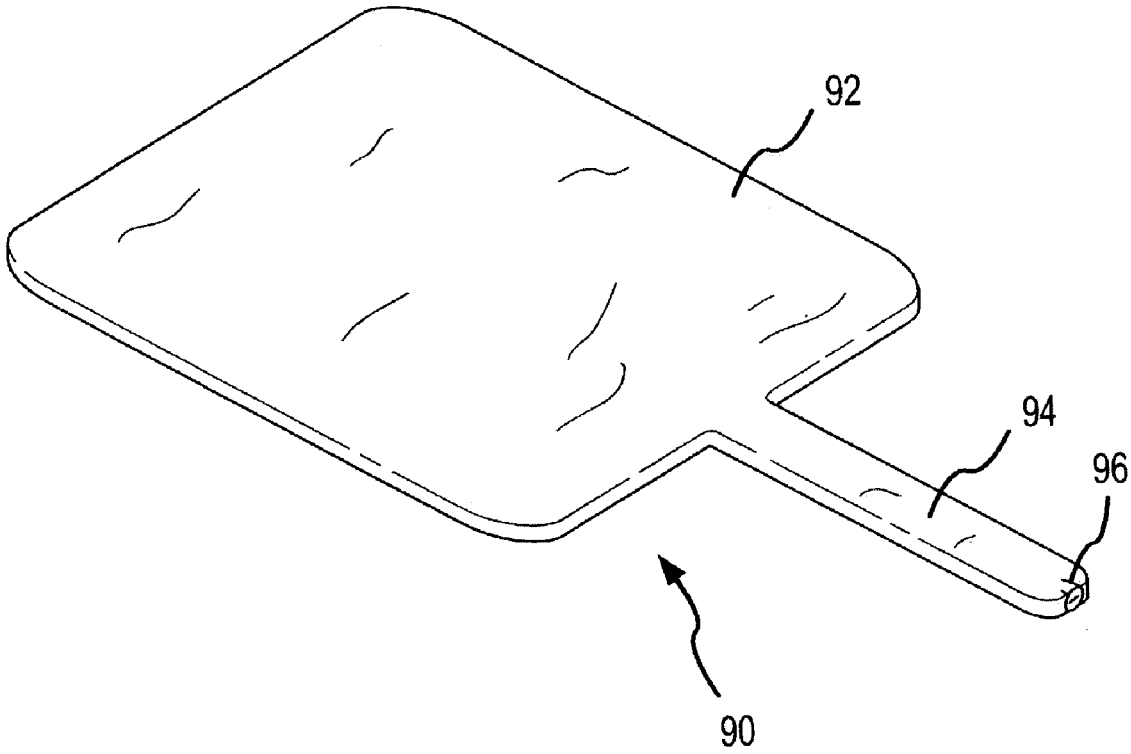
FIG. 14 is a perspective view of another embodiment of a clearance measuring device in accordance with the present invention.

Another embodiment 90 of the clearance measuring device of the present invention is shown in FIG. 14. The clearance measurement device 90 is formed by an air-tight envelope 92. A neck 94 extends from the envelope 92, and a valve 96 is connected to the end of the neck 94. Air or other fluid is inserted through the valve 96 and neck 94 into the envelope 92. The valve 96 is a one-way valve which permits the insertion of fluid through it, but confines the inserted fluid until pressure forces the fluid back out of the valve 96. The amount of air or other fluid which is inserted is sufficient to inflate the envelope 92 to a predetermined amount. For example, the amount of inflation of the envelope might be sufficient to create a substantial uniform thickness of approximately 0.5 inch.

To use the device 90, the device 90 is positioned at the desired location for measuring a clearance between a desired portion of a support contour 22 and the anatomy of the user. Thereafter, the user contacts his or her anatomy with the support contour at the location of the device 90. Pressure from the anatomical contact with the inflated envelope 92 causes the air or fluid to escape from the valve 96, until the envelope 92 is deflated into the space defined by the clearance. Once deflated into the space defined by the clearance, there is no longer sufficient pressure to force the air or fluid from the valve 96.

The extent of clearance is evaluated by removing the device 90 and then evaluating the thickness of the envelope 92. The thickness of the envelope 92 is reflected by the amount of air remaining in the envelope, and that amount of air generally represents the amount of clearance. To use the device 90 effectively, the envelope 92 should be of approximately the desired size of the clearance area of the support contour which is to be measured. A larger envelope would allow air or fluid to be confined within or expelled from the envelope 92 from pressure at locations other than the position where the clearance is measured. The amount of remaining air under these conditions would not adequately represent the clearance at the desired location of measurement, because the extent to which the air was confined or expelled from the envelope at the other locations would inaccurately affect the thickness of the envelope 92 as a measurement of the clearance at the desired location.

All three embodiments 60, 80 and 90 of clearance measuring devices can be positioned at locations where contact of the user's anatomy with the support contour makes it impossible to feel the extent of clearance on an accurate and reliable basis. The clearance measurement devices 60, 80 and 90 can be constructed relatively inexpensively. The devices 80 and 90 can be reused by evening out the thickness of the pad 82 or by adding more air to the envelope 92. Although the foam pad 62 cannot be reused, the cost of the impression foam used in the device 60 is relatively inexpensive. Each of the clearance measuring devices is effective in measuring the clearance under static and dynamic conditions. No sophisticated equipment or training is required in order to evaluate the clearance.

One of the particularly useful aspects of the clearance measuring devices of the present invention is to assist a user in selecting a wheelchair seat cushion having a support contour 22 with adequate support characteristics for that user's anatomy. In the circumstance where a few different wheelchair seat cushions with different support contours 22 are used to address the needs of a substantial portion of the wheelchair user population without using a custom cushion, as discussed more particularly in the above-referenced U.S. patent application Ser. No. 10/628,859, the adequacy of each different cushion is easily determined by placing one of the clearance measuring devices 60, 80 or 90 between the user and the support contour of the proposed wheelchair seat cushion to evaluate the extent of clearance and thus the effectiveness of the support contour with respect to the bony prominences of that particular user. To evaluate the clearance under exaggerated conditions, the user may even be forced downward into the support contour. The added force allows evaluation of the adaptability of the clearance to change. In this manner, the proper size and fit of a wheelchair cushion for a particular user is readily determined.

Another particularly advantageous use of the clearance measuring devices of the present invention is to evaluate the effectiveness of a seat cushion after it has been used for some amount of time. The support contour of the seat cushion may tend to break down with use, with certain areas of the support contour failing to provide adequate clearance to protect against pressure points that could create pressure ulcers. Wheelchair users are also subject to a certain degree of tissue atrophy. The tissue atrophy changes the anatomical contour and may cause pressure points, or diminish a clearance that could lead to pressure points. Under these circumstances, the use of the clearance measuring devices will quickly reveal the extent of the clearance and the necessity to obtain a new or different wheelchair cushion. Many other advantages and improvements will be apparent upon gaining a full appreciation of the significance of the present invention.

A presently preferred embodiment of the present invention and many of its improvements have been described with a degree of particularity. This description is a preferred example of implementing the invention, and is not necessarily intended to limit the scope of the invention. The scope of the invention is defined by the following claims.

What is claimed:

1. A method of evaluating clearance between a support contour of a seat cushion and an adjacent pelvic and proximal thigh anatomical portion of a person sitting on the cushion, comprising:

selecting a piece of impression foam as a clearance measurement device, the impression foam having a crush characteristic which collapses the impression foam upon the application of force to the impression foam;

locating the clearance measurement device on the support contour at a predetermined location where the clearance is to be evaluated;

sitting the person on the cushion with the clearance measurement device located between the anatomical portion and the support contour at the predetermined location where the clearance is to be evaluated;

evaluating the clearance at the predetermined location by determining the extent of collapse of the impression foam as a result of the person sitting on the cushion with the anatomical portion adjacent to the support contour while the impression foam was located at the predetermined location; and evaluating the clearance by attempting to collapse the impression foam to a greater extent than the impression foam was collapsed by sitting the person on the cushion with the anatomical portion adjacent to the support contour.

2. A method as defined in claim 1, used to measure the clearance with respect to a wheelchair user and a wheelchair cushion.

3. A method as defined in claim 1, further comprising:

selecting the impression foam to have the crush characteristic which has the capability to collapse to at least 90% of an initial thickness of non-collapsed impression foam.

4. A method as defined in claim 1, further comprising:

selecting the impression foam to have the crush characteristic which has the capability to collapse to a predetermined fraction of an initial thickness of non-collapsed impression foam, and selecting the impression foam with the predetermined fraction being sufficiently small to avoid creating an unnatural force against the anatomical portion upon the impression foam fully collapsing.

5. A method as defined in claim 1, further comprising:

selecting the impression foam to have the crush characteristic in which a crushing force is within the range of 1.50 to 1.85 pounds per square inch.

6. A method as defined in claim 1, further comprising:

selecting the impression foam to have the crush characteristic in which a crushing force is approximately 1.56 pounds per square inch.

7. A method of evaluating clearance between a support contour of a seat cushion and an adjacent pelvic and proximal thigh anatomical portion of a person sitting on the cushion, comprising:

selecting a piece of impression foam as a clearance measurement device, the impression foam having a crush characteristic which collapses the impression foam upon the application of force to the impression foam;

locating the clearance measurement device on the support contour at a predetermined location where the clearance is to be evaluated;

sitting the person on the cushion with the clearance measurement device located between the anatomical portion and the support contour at the predetermined location where the clearance is to be evaluated;

evaluating the clearance at the predetermined location by determining the extent of collapse of the impression foam as a result of the person sitting on the cushion with the anatomical portion adjacent to the support contour while the impression foam was located at the predetermined location; and evaluating the clearance by forming a hole through the impression foam at a location where the impression foam was collapsed by sitting the person on the cushion with the anatomical portion adjacent to the support contour.

8. A method as defined in claim 7, used to measure the clearance with respect to a wheelchair user and a wheelchair cushion.

9. A method as defined in claim 7, further comprising:

selecting the impression foam to have the crush characteristic which has the capability to collapse to at least 90% of an initial thickness of non-collapsed impression foam.

10. A method as defined in claim 7, further comprising:

selecting the impression foam to have the crush characteristic which has the capability to collapse to a predetermined fraction of an initial thickness of non-collapsed impression foam, and selecting the impression foam with the predetermined fraction being sufficiently small to avoid creating an unnatural force against the anatomical portion upon the impression foam fully collapsing.

11. A method as defined in claim 7, further comprising:

selecting the impression foam to have the crush characteristic in which a crushing force is within the range of 1.50 to 1.85 pounds per square inch.

12. A method as defined in claim 7, further comprising:

selecting the impression foam to have the crush characteristic in which a crushing force is approximately 1.56 pounds per square inch.

13. A method of evaluating clearance between a support contour of a seat cushion and an adjacent pelvic and proximal thigh anatomical portion of a person sitting on the cushion, comprising:

selecting a piece of impression foam as a clearance measurement device, the impression foam having a crush characteristic which collapses the impression foam upon the application of force to the impression foam;

locating the clearance measurement device on the support contour at a predetermined location where the clearance is to be evaluated;

sitting the person on the cushion with the clearance measurement device located between the anatomical portion and the support contour at the predetermined location where the clearance is to be evaluated;

evaluating the clearance at the predetermined location by determining the extent of collapse of the impression foam as a result of the person sitting on the cushion with the anatomical portion adjacent to the support contour while the impression foam was located at the predetermined location; and enclosing the piece of impression foam within a flexible plastic envelope prior to locating the clearance measurement device on the support contour at the predetermined location where the clearance is to be evaluated.

14. A method as defined in claim 13, further comprising:

selecting the impression foam to have the crush characteristic which has the capability to collapse to at least 80% of an initial thickness of non-collapsed impression foam.

15. A method as defined in claim 13, further comprising:

selecting the impression foam to have the crush characteristic which has the capability to collapse to at least 90% of an initial thickness of non-collapsed impression foam.

16. A method as defined in claim 13, further comprising:

selecting the impression foam to have the crush characteristic which has the capability to collapse to a predetermined fraction of an initial thickness of non-collapsed impression foam, and selecting the impression foam with the predetermined fraction being sufficiently small to avoid creating an unnatural force against the anatomical portion upon the impression foam fully collapsing.

17. A method as defined in claim 13, further comprising:

selecting the impression foam to have the crush characteristic in which a crushing force is within the range of 1.50 to 1.85 pounds per square inch.

18. A method as defined in claim 13, further comprising:

selecting the impression foam to have the crush characteristic in which a crushing force is approximately 1.56 pounds per square inch.

19. A method as defined in claim 13, used to measure the clearance with respect to a wheelchair user and a wheelchair cushion.

20. A method of evaluating clearance between a support contour of a seat cushion and an adjacent pelvic and proximal thigh anatomical portion of a person sitting on the cushion, comprising:

selecting a putty-like substance as a clearance measurement device which deforms in response to force applied thereto, the putty-like substance having a malleable characteristic which indents the putty-like substance upon the application of force to the putty-like substance;

locating the clearance measurement device on the support contour at a predetermined location where the clearance is to be evaluated;

sitting the person on the cushion with the clearance measurement device located between the anatomical portion and the support contour at the predetermined location where the clearance is to be evaluated;

evaluating the clearance at the predetermined location by determining the extent of indention of the putty-like substance as a result of the person sitting on the cushion with the anatomical portion adjacent to the support contour while the putty-like substance was located at the predetermined location;

measuring an initial thickness of the putty-like substance prior to locating the putty-like substance on the support contour at the predetermined location where the clearance is to be evaluated and prior to sitting the person on the cushion with the anatomical portion adjacent to the support contour;

forming a hole through the putty-like substance at a location corresponding to the predetermined location where the clearance is to be evaluated after the person sat on the cushion with the anatomical portion adjacent to the support contour;

measuring the thickness of the putty-like substance at the hole; and evaluating the clearance by comparing the measured thickness with the initial thickness.

21. A method as defined in claim 20, further comprising:

establishing a predetermined thickness of the putty-like substance prior to locating the putty-like substance on the support contour at the predetermined location where the clearance is to be evaluated and prior to sitting the person on the cushion with the anatomical portion adjacent to the support contour while the putty-like substance was located at the predetermined location.

22. A method as defined in claim 21, further comprising:

evaluating the clearance by determining whether the putty-like substance has been indented with respect to the predetermined thickness.

23. A method as defined in claim 22, further comprising:

establishing the predetermined thickness uniformly over an entire surface of the putty-like substance.

24. A method as defined in claim 23, further comprising:

determining an initial thickness of the putty-like substance prior to locating the putty-like substance on the support contour at the predetermined location where the clearance is to be evaluated and prior to sitting the person on the cushion with the anatomical portion adjacent to the support contour while the putty-like substance was located at the predetermined position; and evaluating the clearance by determining whether the initial thickness of the putty-like substance has changed as a result of sitting the person on the cushion with the anatomical portion adjacent to the support contour.

25. A method as defined in claim 20, used to measure the clearance with respect to a wheelchair user and a wheelchair cushion.

26. A method of evaluating clearance between a support contour of a seat cushion and an adjacent pelvic and proximal thigh anatomical portion of a person sitting on the cushion, comprising:

selecting a putty-like substance as a clearance measurement device which deforms in response to force applied thereto, the putty-like substance having a malleable characteristic which indents the putty-like substance upon the application of force to the putty-like substance;

locating the clearance measurement device on the support contour at a predetermined location where the clearance is to be evaluated;

sitting the person on the cushion with the clearance measurement device located between the anatomical portion and the support contour at the predetermined location where the clearance is to be evaluated;

evaluating the clearance at the predetermined location by determining the extent of indention of the putty-like substance as a result of the person sitting on the cushion with the anatomical portion adjacent to the support contour while the putty-like substance was located at the predetermined location; and enclosing the putty-like substance within a flexible plastic envelope prior to locating the clearance measurement device on the support contour at a predetermined location where the clearance is to be evaluated.

27. A method as defined in claim 26, used to measure the clearance with respect to a wheelchair user and a wheelchair cushion.

28. A method as defined in claim 26, further comprising:

establishing a predetermined thickness of the putty-like substance prior to locating the putty-like substance on the support contour at the predetermined location where the clearance is to be evaluated and prior to sitting the person on the cushion with the anatomical portion adjacent to the support contour while the puffy-like substance was located at the predetermined location.

29. A method as defined in claim 28, further comprising:

evaluating the clearance by determining whether the putty-like substance has been indented with respect to the predetermined thickness.

30. A method as defined in claim 29, further comprising:

establishing the predetermined thickness uniformly over an entire surface of the putty-like substance.

31. A method as defined in claim 26, further comprising:

determining an initial thickness of the putty-like substance prior to locating the putty-like substance on the support contour at the predetermined location where the clearance is to be evaluated and prior to sitting the person on the cushion with the anatomical portion adjacent to the support contour while the putty-like substance was located at the predetermined location; and evaluating the clearance by determining whether the initial thickness of the putty-like substance has changed as a result of sitting the person on the cushion with the anatomical portion adjacent to the support contour.

32. A method of evaluating clearance between a support contour of a seat cushion and an adjacent pelvic and proximal thigh anatomical portion of a person sitting on the cushion, comprising:

selecting a clearance measurement device which deforms in response to force applied thereto;

selecting the clearance measurement device to include a flexible envelope containing fluid;

locating the clearance measurement device on the support contour at a predetermined location where the clearance is to be evaluated;

sitting the person on the cushion with the clearance measurement device located between the anatomical portion and the support contour at the predetermined location where the clearance is to be evaluated;

applying pressure to conduct the fluid from the envelope by sitting the person on the cushion with the envelope between the anatomical portion and the support contour; and evaluating the clearance at the predetermined location by determining amount of fluid remaining in the envelope after the person has been sitting on the cushion with the anatomical portion adjacent the support contour while the clearance measurement device was located at the predetermined location.

33. A method as defined in claim 32, further comprising:

establishing a predetermined initial amount of fluid in the envelope prior to locating the envelope on the support contour at the predetermined location where the clearance is to be evaluated and prior to sitting the person on the cushion with the anatomical portion adjacent to the support contour.

34. A method as defined in claim 32, further comprising:

conducting the fluid from the envelope through a one-way valve which permits fluid flow out of the envelope and prevents fluid flow into the envelope.

35. A method as defined in claim 32, further comprising:

measuring the amount of fluid in the envelope prior to locating the envelope on the support contour at the predetermined location where the clearance is to be evaluated and prior to sitting the person on the cushion with the anatomical portion adjacent to the support contour;

measuring the amount of fluid remaining in the envelope after the person has been sitting on the cushion with the anatomical portion adjacent the support contour while the flexible envelope containing fluid was located at the predetermined location; and evaluating the clearance by comparing the measured initial amount of fluid with the measured remaining amount of fluid.

36. A method as defined in claim 32, used to measure the clearance with respect to a wheelchair user and a wheelchair cushion.

37. A method of evaluating clearance between a plurality of different support contours of seat cushions and an adjacent pelvic and proximal thigh anatomical portion of a person sitting on each cushion while supported by the different support contours in order to determine an appropriate support contour for a cushion to support the anatomical portion of the person, the method comprising:

selecting a clearance measurement device which deforms in response to force applied thereto;

locating the clearance measurement device on the support contour at a predetermined location where the clearance is to be evaluated;

sitting the person on the cushion with the clearance measurement device located between the anatomical portion and the support contour at the predetermined location where the clearance is to be evaluated;

evaluating the clearance at the predetermined location by determining the extent to which the clearance measurement device was deformed as a result of the person sitting on the cushion with the anatomical portion adjacent to the support contour while the clearance measurement device was located at the predetermined location;

performing the aforesaid locating, sitting and evaluating steps with a cushion having a first support contour to obtain a first clearance from the first support contour;

performing the aforesaid locating, sitting and evaluating steps with a cushion having a second support contour to obtain a second clearance from the second support contour at substantially the same predetermined location that the first clearance was obtained from the first support contour; and selecting one of the first or second support contours by evaluating the first and second clearances relative to one another.

38. A method as defined in claim 37, further comprising:

selecting the clearance measurement device to include a piece of impression foam having a crush characteristic which collapses the impression foam upon the application of force to the impression foam; and evaluating the clearance at the predetermined location by determining the extent of collapse of the impression foam.

39. A method as defined in claim 37, further comprising:

selecting the clearance measurement device to include a piece of putty-like substance having a malleable characteristic which indents the putty-like substance upon the application of force to the putty-like substance; and evaluating the clearance at the predetermined location by determining the extent of indention of the putty-like substance.

40. A method as defined in claim 37, further comprising:

using as the clearance measurement device a flexible envelope containing fluid;

applying pressure to conduct the fluid from the envelope by sitting the person on the cushion with the envelope between the anatomical portion and the support contour; and evaluating the clearance at the predetermined location by determining the amount of fluid remaining in the envelope after the person has been sitting on the cushion with the anatomical portion adjacent the support contour while the clearance measurement device was located at the predetermined location.

41. A method as defined in claim 37, used to measure the clearance with respect to a wheelchair user and a wheelchair cushion.

42. A method as defined in claim 37 wherein the clearance measurement device includes an impression foam.

43. A method as defined in claim 37 wherein the clearance measurement device includes a putty-like substance.

44. A method as defined in claim 37 wherein the clearance measurement device includes a flexible envelope containing a fluid.

* * * * *